US006902173B2

(12) United States Patent
Borel et al.

(10) Patent No.: US 6,902,173 B2
(45) Date of Patent: Jun. 7, 2005

(54) FRAME FOR A SKATE, AND A SKATE HAVING SUCH FRAME

(75) Inventors: René Borel, Saint-Sylvestre (FR); Shane Coburn, Costa Mesa, CA (US); Dustin Latimer, Chandler, AZ (US)

(73) Assignee: Salomon S.A., Metz-Tessy (FR)

( * ) Notice: Subject to any disclaimer, the term of this patent is extended or adjusted under 35 U.S.C. 154(b) by 145 days.

(21) Appl. No.: 10/197,557

(22) Filed: Jul. 18, 2002

(65) Prior Publication Data

US 2004/0012163 A1 Jan. 22, 2004

(51) Int. Cl.[7] ..... A63C 17/04
(52) U.S. Cl. ..... 280/11.233
(58) Field of Search ..... 280/11.233, 11.19, 280/11.221, 11.231, 11.27, 11.28; D21/764; 36/115

(56) References Cited

U.S. PATENT DOCUMENTS

| | | | | | |
|---|---|---|---|---|---|
| D134,931 | S | * | 2/1943 | Yuill | D21/764 |
| 4,138,127 | A | * | 2/1979 | Kimmell et al. | 280/11.227 |
| 4,146,241 | A | * | 3/1979 | Stevenson | 280/11.27 |
| 4,294,455 | A | * | 10/1981 | Krueger | 280/11.209 |
| 4,618,158 | A | * | 10/1986 | Liberkowski | 280/843 |
| 5,326,115 | A | * | 7/1994 | Seltzer | 280/11.19 |
| D359,542 | S | * | 6/1995 | Sherman et al. | D21/764 |
| D392,360 | S | * | 3/1998 | Iverson | D21/764 |
| 5,836,591 | A | * | 11/1998 | Roderick et al. | 280/11.233 |
| 5,947,486 | A | * | 9/1999 | Zell | 280/11.201 |
| 5,967,552 | A | | 10/1999 | Roderick et al. | 280/843 |
| 6,029,983 | A | * | 2/2000 | Wegener | 280/11.231 |
| D425,595 | S | * | 5/2000 | Borel et al. | D21/764 |
| 6,056,302 | A | | 5/2000 | Smith | 280/87.042 |
| 6,340,164 | B1 | * | 1/2002 | Borel | 280/11.225 |
| 6,394,469 | B1 | | 5/2002 | Borel | 280/11.225 |
| 2003/0146584 | A1 | * | 8/2003 | Gaus | 280/11.27 |
| 2003/0227144 | A1 | * | 12/2003 | Johnson | 280/11.233 |

FOREIGN PATENT DOCUMENTS

| | | |
|---|---|---|
| CH | 55385 | * 12/1911 |
| DE | 29716751 U | 1/1998 |
| EP | 0891794 | 1/1999 |
| FR | 2668072 | 4/1992 |
| GB | 2315680 | 2/1998 |

* cited by examiner

*Primary Examiner*—Bryan Fischmann
(74) *Attorney, Agent, or Firm*—Greenblum & Bernstein, P.L.C.

(57) ABSTRACT

A frame for a skate, and a skate having a frame, the frame including a lower longitudinally elongated member for supporting the wheels of the skate, a housing at opposite ends of the elongated member, each housing demarcated by a pair of lateral walls between which is assembled a respective wheel mounted on an axle. The elongated member further includes, or has attached thereto between the wheel housings, a lower arc demarcated by a surface facing a line defined by the contact points of the two wheels while supported on a planar surface. The arc extends over a length equal to or greater than a third of the distance between the two wheel axles at each of the ends of the elongated member of the frame.

30 Claims, 5 Drawing Sheets

FRAME FOR A SKATE, AND A SKATE HAVING SUCH FRAME

BACKGROUND OF THE INVENTION

1. Field of the Invention

The invention relates to a roller skate, in particular a skate enabling its wearer to execute figures.

2. Description of Background and Relevant Information

A skate of the above-mentioned type is known for a so-called aggressive skating style in which the skater executes sliding or jumping figures, i.e., tricks, on obstacles that he or she encounters in the streets and otherwise, such as in urban or park areas, particularly curbs, the edges of sidewalks, concrete walls, stair railings, benches, and ramps for example.

European Patent Application 0 891 794, and its counterpart, U.S. Pat. No. 6,394,469, describe a skate for this type of skating style.

The skate includes a frame upon which a shell and a liner for the skater's foot are affixed.

The frame has two lengthy and parallel vertical flanges that form a groove in which four in-line wheels are mounted. Between the two middle wheels, the flanges of the frame are hollowed out so as to form a sort of arc oriented transversely with respect to the longitudinal direction defined by the frame.

The skater uses this arc, for instance, to slide along the edge of a sidewalk or a stair railing with the skate turned sideways. The arc is used as a guiding support during a sliding phase and as an impulse support when jumping. Two other support zones of the skate are also used for executing various tricks or figures. They are the two corner surfaces demarcated by the sole of the shell, or the support plate of the boot, and the flanges of the frame on the medial and lateral sides. Any time the skater slides, but does not roll with the wheels, with a part of the skate, it is called "grinding." When this sliding occurs in the zone separating the two middle wheels, it is called "royal grinding."

As for the arc, its dimensions in height and length are relatively reduced given its positioning between the middle wheels. As a result, the range of movement and the possibilities for movement for the skater are relatively limited and, therefore, the skater is restricted to a grind in which the skate is maintained transverse, generally perpendicular, to the railing or the edge of the obstacle.

SUMMARY OF THE INVENTION

One object of the invention is to improve the aforementioned possibilities for movement and to give greater fluidity to the figures that the skater executes.

To this end, the invention proposes a frame, and a skate having such frame, with an elongated lower member for supporting the wheels which extends along the longitudinal direction defined by the frame, the elongated wheel-supporting member having a housing at each of its ends demarcated by two lateral walls between which is assembled a wheel mounted on an axle, and the elongated wheel-supporting member having between the wheel housings, or attached thereto, a lower arc demarcated by a surface, such as a curved surface, extending inwardly of the skate with respect to a line defined by the contact points of the two wheels on a planar surface, wherein the arc extends over a length equal to or greater than a third of the distance between the axes of the two wheel axles. Furthermore, the geometry of the arc ensures a deflector function such that, when the skater is in the position to grind, a turn of 180° or more can be accomplished, including "circular" grinds, while having the frame remaining in contact with the railing or other obstacle and without the wheels touching it.

In a preferred embodiment of the invention, the deflector function is ensured by the presence of extensions, or fairings, provided at the ends of the arc and that cover the lower part of the wheels located toward the inside of the lower wheel-supporting member of the frame.

In another preferred embodiment of the invention, the geometry of the arc is such that if one were to imagine extending the arc in the direction toward each of the two wheels, the imaginary line thus made passes underneath the wheels. Preferably, the imaginary line is substantially tangential to the periphery of the wheels while passing underneath.

BRIEF DESCRIPTION OF DRAWINGS

The invention will be better understood with reference to the following description and attached drawings of non-limiting embodiments of the invention, in which.

DETAILED DESCRIPTION OF THE PREFERRED EMBODIMENTS

Figure 1:
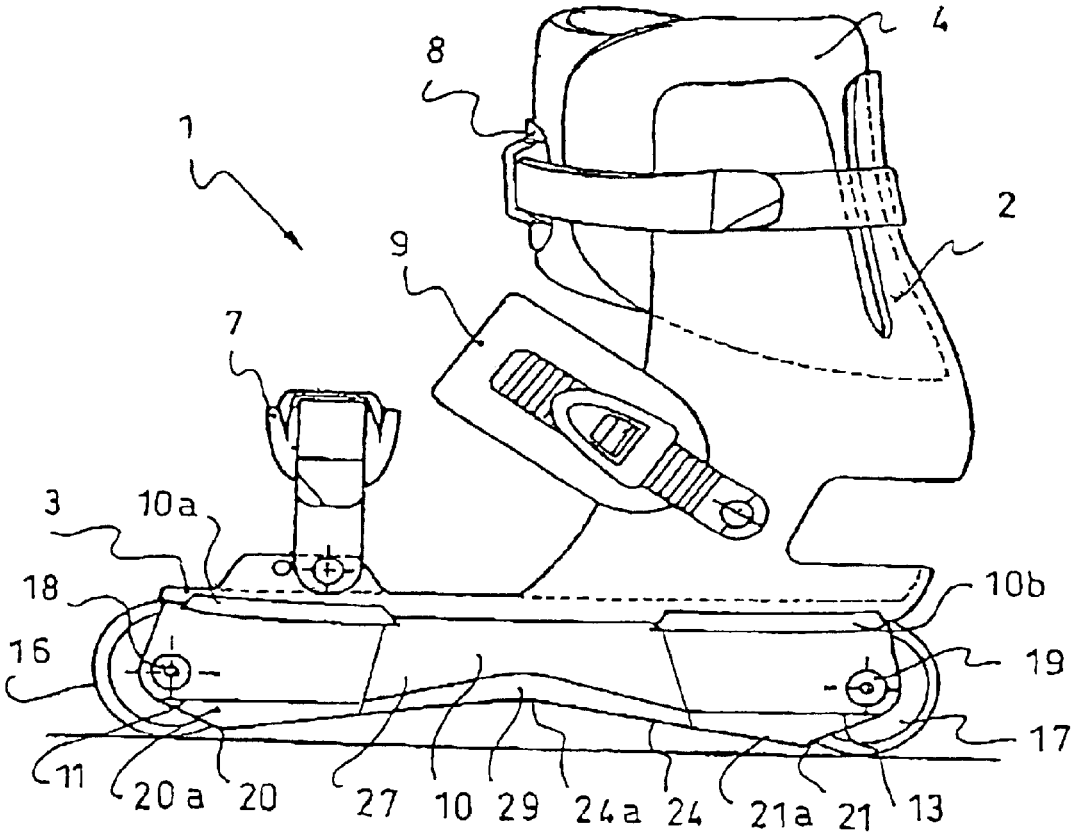
FIG. 1 shows a side view of a skate according to a first embodiment of the invention.

The skate 1 shown in FIG. 1 has, in its upper portion, a shell 2 provided to receive a boot.

The shell has a support plate 3 provided to receive a boot sole and an upper 4 that extends upwardly along the skater's ankle. As shown, particularly because the invention is directed to an "aggressive" skate, the support plate preferably extends along a single horizontal plane to be mounted upon a mating planar surface of the frame, the frame being further described below.

The skater's foot and boot are immobilized in the shell by a metatarsal strap 7, a lower leg strap 8, and an instep strap 9. The straps 7, 8, 9 can be fitted with padded cushions if desired. It is within the scope of the invention to immobilize the foot and boot by other means, instead of or in addition to straps, such as buckles, for example.

The shell is made of any appropriate material, particularly plastic that, optionally, can be fiber-reinforced.

The construction that has just been described is not limiting and, instead of a shell provided to receive a boot, one could provide the skate with a rigid cradle having a flexible liner in which the skater directly places his/her foot. Other constructions are also considered to be within the scope of the invention.

With reference to FIG. 1, the frame of the skate includes a lower elongated member 10 for supporting the wheels 16, 17 beneath the shell 2 of the skate.

The elongated member 10 extends longitudinally along the shell 2 and in a continuous manner substantially over its entire length. At each of its ends, the elongated member 10 has a housing demarcated by two lateral walls or flanges 11, 12 and 13, 14. A wheel 16, 17 is housed in each of the housings, respectively, and it is mounted on an axle, respectively, extending along axes 18, 19, supported by the side walls of the elongated member 10. The wheels 16, 17 can be of any appropriate type. It is preferred that the diameter of the wheels be relatively small. Good results can be achieved with wheels having a diameter of 54–58 millimeters, although this particular dimension is not to be considered as limiting. Because there are only two wheels for supporting the skater rather than four, the surface available for the grind is larger, as much as 50% larger or more.

Further, the top surface of the elongated member 10 preferably extends along a single horizontal plane, parallel to the axes of the wheels of the skate, to mate with the above-mentioned support plate of the boot. It is contemplated that the elongated member 10 can additionally include front and rear horizontally and outwardly projecting portions 10*a*, 10*b* for supporting the boot, as described in U.S. Pat. No. 6,394,469, for example, the disclosure of which is incorporated by reference thereto for this purpose. Such support portions could be made unitarily with the remainder of the elongated member 10 or each such portion could be separately affixed thereto, such as by means of longitudinal grooves and ribs on the upper regions at the ends of the elongated member 10 and the supporting portions, respectively. As mentioned in the aforementioned patent, the lower surfaces of the projecting portions would provide sliding surfaces for the skater, which extend along a common plane.

As seen in FIG. 1, the height of the lower elongated member 10 is slightly less than the diameter of the wheel 16 or 17, and the axles of the wheels are preferably placed toward the middle of the height of the elongated member 10, in the area of a protuberance of the side walls so that the wheels are clear of the elongated member 10 toward the front and rear of the skate.

Also, in a preferred manner, the elongated member 10 of the frame includes lower extensions 20, 21, or fairings, that are flush with, or substantially flush with, the surface defined by the contact lines between the wheels and the ground. See FIG. 1, e.g., in this regard. In this manner, the elongated member 10 offers a ground clearance that is minimized toward the two ends of the elongated member 10. More specifically for the embodiment shown, the extensions 20, 21 extend the elongated member to the wheels so as to surround the lower portions of the wheels that are located toward the inside of the elongated member 10, in the nature of a fairing on a motorcycle, particularly a lower fairing of a motorcycle, for example. These extensions then function as deflectors that avoid wheel contact with the grinding surface, such as a railing, for example. Preferably, on each side of the wheels, the extensions have beveled sides 20*a*, 20*b*, 21*a*, 21*b*, respectively, to avoid contact between the extensions 20, 21 and the ground or sliding surface if the skate is inclined.

Between the two extensions 20 and 21, the lower surface 24 of the elongated member 10 defines an arc, or arch, demarcated by a lower surface, preferably a smooth surface, and preferably curved in total or in part, the surface extending inwardly toward the remainder of the skate, and facing a line defined by the contact points of the two wheels when supported on a planar surface as shown in FIG. 1.

Figure 2:
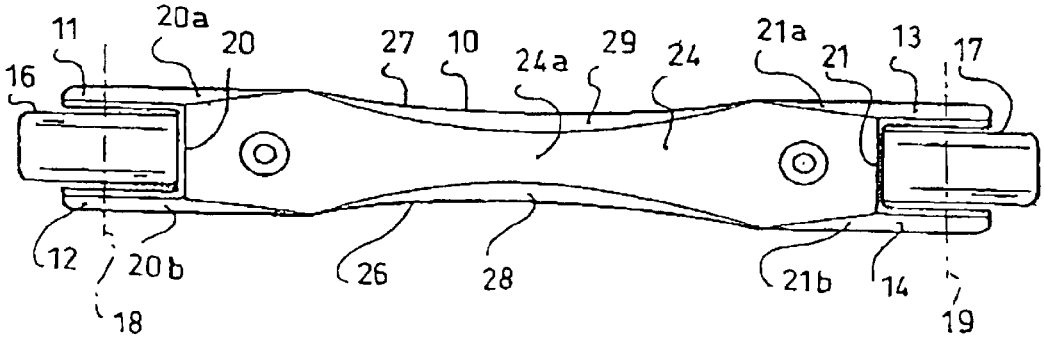
FIG. 2 is a bottom view of the elongated member of the frame for supporting the wheels.
Figure 3:
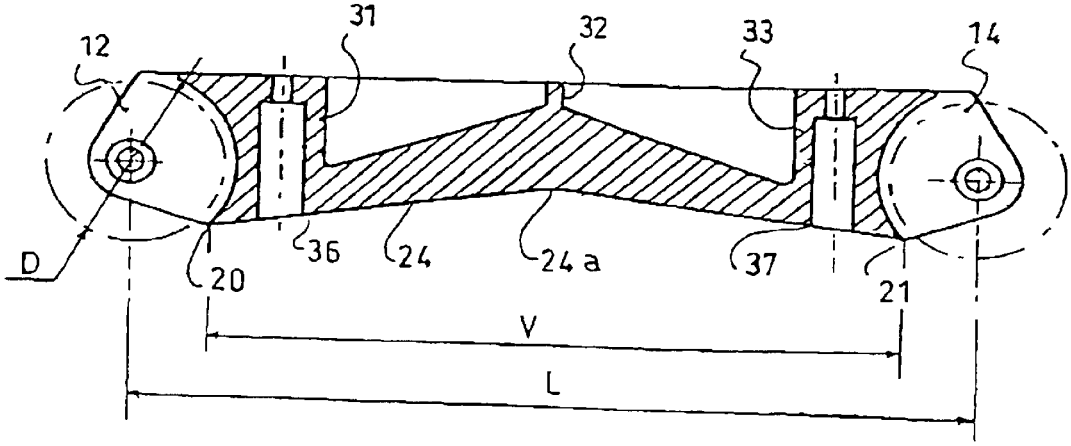
FIG. 3 is a cross-sectional view of the wheel-supporting member of FIG. 2.

According to the embodiment of FIGS. 1–3, the curvature of the arc 24 is not constant. The arc has a curved surface in its median portion, and inclined and planar, or substantially planar, surfaces extending toward each of the ends of the arc. However, this is not limiting, and the radius of curvature could vary along the length of the arc or it could be constant along the length thereof. Likewise, the arc could be asymmetrical with respect to its median portion. For example, the apex of the arc could be located at other than precisely in the middle of the elongated member 10 of the frame.

According to the embodiment shown, the curved surface of the median portion of the arc corresponds to the apex 24*a* of the arc, which is located slightly below the axes 18, 19 of the wheels. This geometry favors the positioning of the skater on the railing; when the skate is exactly perpendicular to the rail, the skate/ramp contact occurs in the area of the apex 24*a* of the arc.

Seen from the top, the elongated member 10 preferably has two lateral curved surfaces 26 and 27 that converge toward each other toward the middle of the length of the elongated member. As with the surface 24, the surfaces 26 and 27 can have a constant or non-constant curvature and be symmetrical or asymmetrical. In fact, these lateral surfaces 26, 27 can themselves form lateral arcs.

In a preferred manner, a beveled zone 28, 29 is located at the junction of the arc 24 and the two lateral surfaces 26 and 27. Instead of one bevel, there could be a plurality of successive bevels with various orientations or yet a rounded junction surface.

In the preferred embodiment shown in FIGS. 1–3, although also within the scope of other embodiments of the invention, the two beveled zones 28, 29 are spaced apart a distance of approximately 20 millimeters at least in the region of the apex 24*a* of the arc 24. At least in the central region of the arc 24, i.e., at least in the area of the apex 24*a* and possibly as far as the housings 36, 37 (further described below) or as far as the two extensions 20, 21, i.e., possibly throughout the entirety of the arc, the arc is flat at least in vertical transverse cross section. That is, in cross section, the aforementioned flat regions of the arc 24 would be represented by a straight horizontal line. This flatness provides the skater with stability and control as he/she is positioned on the sliding obstacle. The arc 24 as shown in FIG. 2 is laterally centered on the elongated member 10 of the frame, that is, it extends on either side of a longitudinal vertical median plane of the elongated member.

The arc 24 and the lateral surfaces 26, 27 are provided to serve as a guiding support during the sliding of the skate along a rail, for instance, while the orientation of the skate might vary with respect to the rail, i.e., with respect to the grind surface. Given the wide span of the arcs with respect to the length of the elongated member 10, the skater has greater ease of movement when executing a trick, such as a grind, and greater support when jumping. The difference between the distance L between the axes of the two axles 18, 19 and the longitudinal extension V of the arc 24 is less than the average diameter of the wheels D. Thus, the extensions 20 and 21 cover part of the wheels in FIGS. 2 and 3, for example. The ground clearance that is minimized in the area of the wheels also improves the possibilities of movement by facilitating the passage of the wheels above the rail, ledges, or other grinding surface or obstacle. The amplitude of the arc substantially increases the possible sliding angle.

The skater is no longer limited to the transverse positioning of the skate with respect to the ramp or sliding surface. A turn with the skate up to 180° and greater with respect to the ramp is even possible without the wheels touching the railing. As a matter of fact, the extensions 20 and 21 ensure the role of a deflector when the orientation of the beam approaches that of the rail.

According to the embodiment shown, the extensions 20, 21 cover the lower portion of the wheels located toward the inside of the elongated member 10. However, this is not limiting, and the extensions can also be constituted by downward extensions of the side walls 11, 12, 13, 14, ensuring the deflector function, as with the embodiment shown.

By providing for the aforementioned extensions 20, 21, the arc of the grinding surface is maximized, that is, the length of the grinding area is increased from that of traditional flat frames, for example. In other words, because the middle of the frame is an arc, rather than a straight line, it creates more area for grinding than that of a traditional frame, even without middle wheels, because an arc between two points is longer than a straight line.

Therefore, because the grinding surface is made longer by means of the extensions, traditional/linear grinds, i.e., frontsides, backsides, royales, backslides, fastslides, and any other grinds where at least one of the skaters two frames are grinding/sliding sideways are accentuated. Further, the invention makes possible new "circular" grinds, in which a skater can switch his/her footing and grinding stance without having the frames of the skates leave the grinding obstacle, but also allows the skater to combine these two types of grinds, viz., linear to circular or circular to linear, without having the frames of the skates leave the grinding surface.

As mentioned above, the extensions, or fairings, are not exclusively extensions of the bottom arc, but include the aforementioned sides 26, 27. In other words, the side of the frame and the arc 24 are connected by another surface, viz., the side of the extension/fairing. This new surface allows skaters to transition more smoothly from "cess slides" (sliding on the side of the boot) to traditional grinds (such as souls, makios, and pornstars). Further, the sides of the frame, i.e., the sides of the elongated member 10 include beveled (or carved out) areas 28, 29 to minimize friction on grinds that utilize the sole of the boot, such as soul grinds, makios, acids, mizous, topsoles, and fishbrains.

The elongated member 10 can be made from any appropriate material, particularly plastic that can be fiber-reinforced and molded, preferably as a one-piece construction, as shown in the embodiment of FIGS. 1–3. As shown in FIG. 3, for example, the elongated member can be manufactured with a U-shaped section having lateral and lower walls defining surfaces of the lower and lateral arcs, with connecting spacers 31, 32, and 33 internally connecting the walls in the proximity of the wheels and toward the middle. Other constructions could also be used.

The elongated member 10 is assembled to the shell 2 or to a boot, depending on the case, by any appropriate means. For example, as it is shown, the elongated member is equipped at the front and rear with two shoulder housings 36, 37 located in the spacer zones 31 and 33 in the proximity of the wheels. These housings 36, 37 are provided for screws for assembling the shell to the upper portion of the elongated member, possibly in cooperation with complementary nesting forms. This assembly method advantageously allows exchanging the skate element that receives the skater's foot or boot. Nevertheless, it is not limiting, and other assembly methods could also be used. For instance, the elongated member 10 and the shell could form a one-piece assembly.

Figure 4:
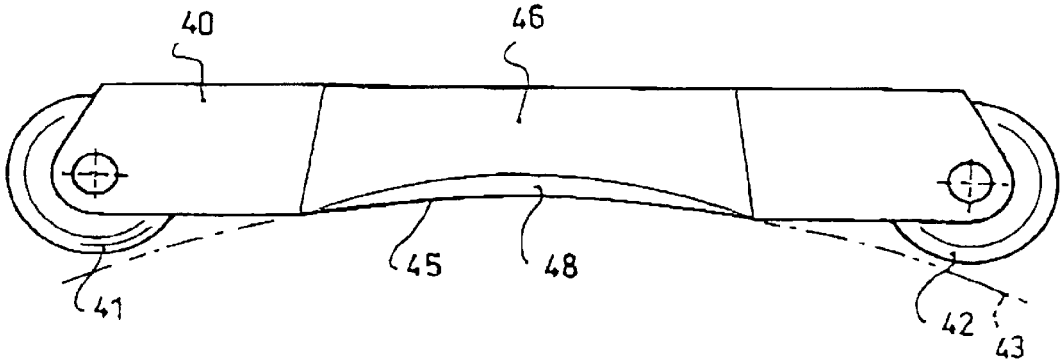
FIG. 4 shows a side view of the wheel-supporting member according to another embodiment of the invention.
Figure 5:
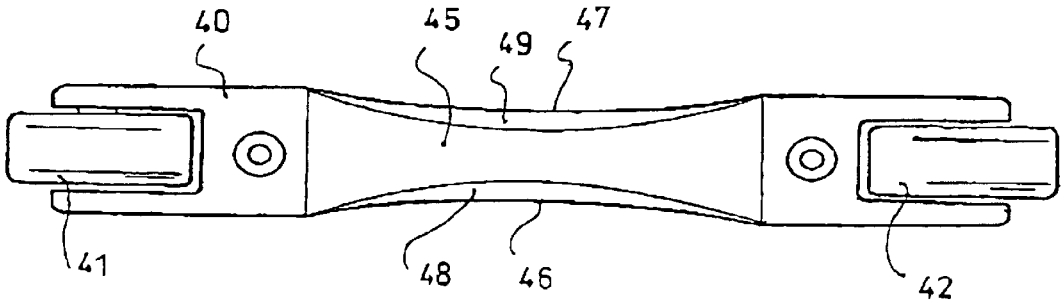
FIG. 5 is a bottom view of the wheel-supporting member of FIG. 4.

FIGS. 4 and 5 show an alternative construction of the frame according to the invention.

As in the previous case, the frame has a lower supporting member 40 equipped with a wheel 41, 42 mounted in respective housings at each of its ends. The elongated member 40 has a lower arc 45, two lateral arcs 46, 47, and two beveled junction zones 48, 49.

Contrary to the previous construction, the arc 45 extends only over a portion of the lower length of the elongated member 40. The arc 45, however, is longer than arcs used up until now for skates, and the frame supports only two wheels. In order to achieve the results expected by the invention, the arc must extend over a distance that is greater than a third of the distance between the axes of the wheels and, preferably, greater than one-half of this distance.

In spite of the lack of lower extensions as in the preceding embodiment, the deflector function of the construction according to FIGS. 4 and 5 is ensured by the particular geometry of the arc. The arc has a constant curvature and its extension toward the two ends of the elongated member 40 defines an imaginary line 43 that is substantially tangent to the periphery of the wheels while remaining lower than this periphery. It is also possible that the lower arc 45 has, as in the preceding embodiment, a curved median zone surrounded by two planar, or substantially planar and inclined zones.

The lateral arcs 46, 47 extend longitudinally as much as the lower arc. However, this is not limiting, and one can provide that the lateral arcs 46, 47 extend over a distance that is different from that of the lower arc 45.

Figures 6, 7:
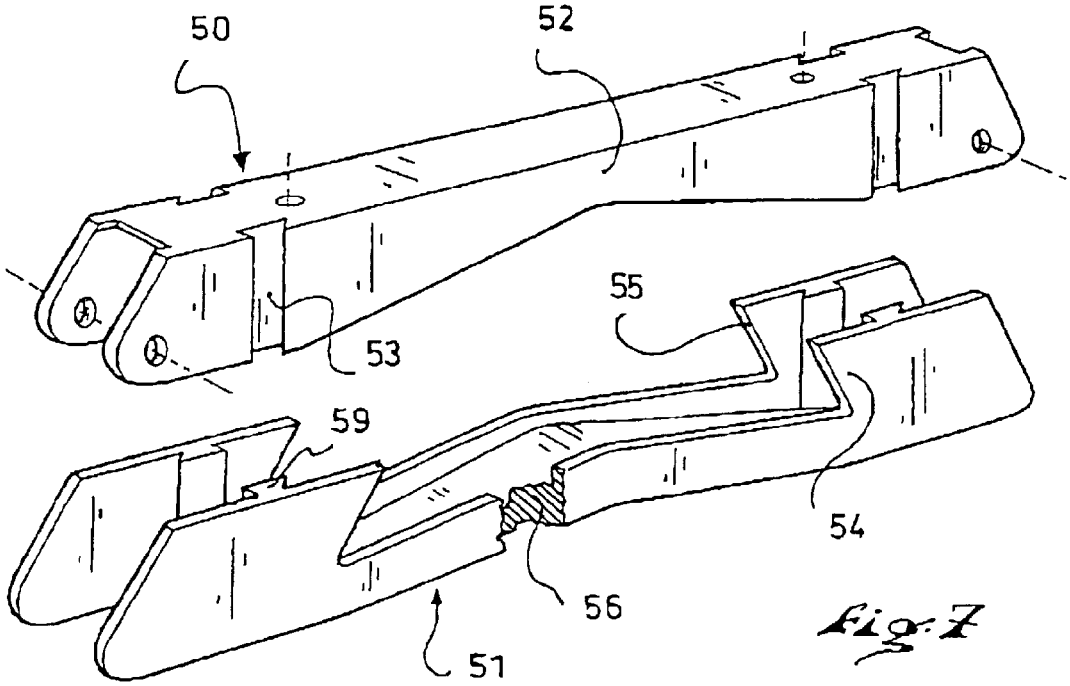
FIG. 6 is a perspective view of an elongated wheel-supporting member according to a third embodiment of the invention.
FIG. 7 is a perspective view of the shoe associated with the elongated member of FIG. 6.
Figure 8:
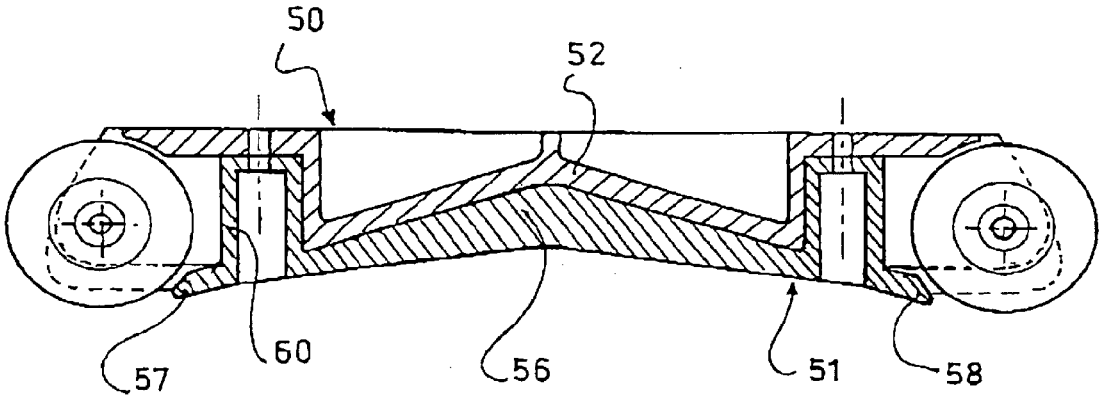
FIG. 8 is a cross-sectional view of the assembly of the shoe and the elongated member of FIGS. 6 and 7.

FIGS. 6, 7 and 8 show a third embodiment of the invention. In this embodiment, the frame provided for attaching the two wheels to each of its ends has two main parts, an upper-positioned elongated member 50 and a lower-positioned shoe 51.

FIG. 6 is a perspective view of the elongated member 50. As in the previous embodiments, the elongated member 50 extends longitudinally and has at each of its ends a housing limited by two lateral walls. Openings are provided in these lateral walls, which allow the attachment of the wheels. Each of the lateral walls is also equipped with a dovetailed vertical slot 53. The central portion of the elongated member 50 is constituted by an arc 52. The elongated member 50 is made from plastic reinforced with glass fiber in order to increase its strength. Like the embodiments described above, the elongated member 50 can additionally include front and rear horizontally and outwardly projecting portions (not shown in FIG. 6) for supporting the boot for providing sliding surfaces for the skater.

FIG. 7 is a perspective view of the shoe 51. The shoe 51 has two lateral sides 54 and 55 that are connected together on their lower sides by a lower part 56 of the shoe which has a lower surface which defines an arc. The longitudinal extension V of the arc is greater than a third of the distance L separating the axes of the two wheel axles. In addition, as shown in FIG. 8, the arc of the lower shoe portion 56 is extended at each of its ends by extensions 57 and 58 adapted to cover a lower portion of the wheels. These extensions 57 and 58 ensure the aforementioned deflector function and prevent wheel contact with the rail, e.g., during a maneuver executed on the rail. The shoe 51 is made of a material that promotes sliding, such as DELRIN®, for example. This is not limiting and another material could be selected.

With the embodiment of FIGS. 7, 8, taken together with the aforementioned embodiments, it can be said that, with regard to any of the embodiments, the longitudinal extension V of the lower arc of the invention is greater than the distance L separating the axes of the two wheels minus the diameter D of the wheels, i.e., V>L−D.

FIG. 8 shows a cross-sectional view of the assembled frame of the third embodiment before it is attached to the boot. The two wheels are mounted in the housings of the elongated member 50. Then the shoe is inserted from underneath into the elongated member 50. As shown in FIG. 7, tenons 59 that project from the inner surfaces of the lateral sides of the shoe 51 cooperate with slots 53 provided in the elongated member 50 to position and maintain the shoe 51 in the elongated member. Cylindrical shafts 60 are made in the shoe which serve to insert two attaching means (not shown) for attaching the shoe 51 and the elongated member 50 to the boot.

In this embodiment of the invention, all of the parts of the frame which come into contact with the surfaces for grinding are constituted by the shoe 51 of the frame, which is interchangeable. The shoe could thus be easily replaced if it is worn out or if the skater desires to modify the sliding properties of the skate. As an example, an inexperienced skater will prefer a shoe with limited sliding capabilities. Another advantage of this embodiment lies in the fact that the wheel axles (not shown) are completely hidden by the shoe 51. Thus, there is no risk of damaging the screw heads that serve to attach the wheels. Furthermore, unscrewing of the wheels and the loss of a wheel when skating are prevented. The profile of the arc is that of a "V", two substantially planar surfaces encompassing a curved median portion. Such a profile gives the skater a reference position, that of a grinding direction perpendicular to the alignment of the two wheels, and that of a contact between the frame and the ramp occurring in the innermost portion of the arc, i.e., in its curved median portion.

The present description is given only as an example, and other embodiments of the invention could be used without leaving the scope thereof.

What is claimed is:

1. A skate comprising:

a frame, said frame including an elongated member, said elongated member including a housing at each of opposite ends of said elongated member, each of said housings being demarcated by two lateral walls at said opposite ends of said elongated member;

a pair of wheels, each of said wheels being mounted in a respective one of said housings for rotation about a respective axis, said axis of a first of said wheels being spaced a predeterminate distance from said axis of a second of said wheels, said pair of wheels being the only wheels for supporting the skate during skating;

a lower arc extending longitudinally between said wheel housings and extending laterally on each side of a vertical longitudinal median plane of said frame, said arc having a surface facing downwardly toward and extending inwardly away from a planar surface supporting said two wheels; and said lower arc having a longitudinal extent greater than a third of said predeterminate distance said axes of said first and second wheels are spaced apart.

2. A skate according to claim 1, wherein said lower arc of said elongated member has a longitudinal extension greater than said distance by which said wheels are spaced apart minus said diameter of said wheels.

3. A skate according to claim 1, wherein said elongated member of said frame includes two lateral arcs that extend over a distance equal to or greater than a third of said distance by which said wheels are spaced apart.

4. A skate according to claim 3, further comprising a U-shaped cross-section having lateral and lower walls defining surfaces of said lower and lateral arcs with connecting spacers internally connecting said lateral and lower walls.

5. A skate according to claim 3, wherein the lower arc and the lateral arcs are connected by beveled zones.

6. A skate according to claim 1, wherein said elongated member comprises lower extensions extending to each of said opposite ends of said elongated member.

7. A skate according to claim 4, wherein said extensions extend to said wheels and at least surround a lower part of said wheels.

8. A skate according to claim 4, wherein said extensions have beveled sides along side each of said wheels.

9. A skate according to claim 1, wherein said lower arc has a constant curvature.

10. A skate according to claim 1, wherein said lower arc has a curvature varying over said longitudinal extent of said arc.

11. A skate according to claim 10, wherein said lower arc comprises a curved surface in a median portion of said arc, and planar and inclined surfaces extending toward each of said opposite ends of said elongated member.

12. A skate according to claim 1, wherein said elongated member has shoulder housings, each of said shoulder housings being adapted to receive a screw provided for assembly of the elongated member to a shell or to a boot.

13. A skate according to claim 1, wherein an imaginary line extending said lower arc toward said two opposite ends of said elongated member passes underneath each of said two wheels.

14. A skate according to claim 1, wherein no wheels are mounted to said frame between said wheels.

15. A skate according to claim 1, wherein each said wheels extends longitudinally beyond a respective one of said opposite ends of said elongated member.

16. A skate according to claim 1, wherein said lower arc is a unitary part of said elongated member.

17. A skate according to claim 1, wherein said frame further comprises a shoe, affixed to a lower portion of said elongated member, said lower arc being part of said shoe.

18. A skate according to claim 1, wherein said lower arc has a longitudinal extent less than said predeterminate distance between said axes but greater than the distance between said wheels.

19. A skate comprising:

a frame, said frame including an elongated member, said elongated member including a housing at each of opposite ends of said elongated member, each of said housings being demarcated by two lateral walls at said opposite ends of said elongated member;

a pair of wheels, each of said wheels being mounted in a respective one of said housings for rotation about a respective axis, said wheels constituting outermost wheels mounted to said frame, said axis of a first of said wheels being spaced a predeterminate distance from said axis of a second of said wheels, said pair of wheels being the only wheels for supporting the skate during skating;

a lower arc extending longitudinally between said wheel housings and extending laterally on each side of a vertical longitudinal median plane of said frame, said arc having a surface facing downwardly toward and extending inwardly away from a planar surface supporting said two wheels; and said lower arc having a longitudinal extent greater than a third of said predeterminate distance said axes of said first and second wheels are spaced apart.

20. A frame for a skate, said frame comprising:

an elongated member, said elongated member including only two wheel housings, a first of said two wheel housings being positioned at a first end of said elongated member, and a second of said two wheel housings being positioned at a second end of said elongated member, each of said two wheel housings being demarcated by a pair of lateral walls, each of said pair of lateral walls having transversely extending openings to mount axles of a respective wheel;

said openings of each of said pairs of lateral walls defining a pair of axes spaced longitudinally apart a predeterminate distance;

a lower arc extending longitudinally between said wheel housings and extending laterally on each side of a vertical longitudinal median plane of said elongated member, said arc having a downwardly facing surface extending inwardly toward an upper surface of said elongated member; and said lower arc having a longitudinal extent greater than a third of said predeterminate distance said pair of axes of said openings are spaced apart.

21. A frame for a skate according to claim 20, wherein said lower arc is a unitary part of said elongated member.

22. A frame according to claim 21, further comprising a front wheel mounted in said first wheel housing of said elongated member and a rear wheel mounted in said second wheel housing of said elongated member.

23. A frame according to claim 22, wherein said lower arc has a longitudinal extent greater than said predeterminate distance between said axes minus a predeterminate diameter of said wheels.

24. A frame for a skate according to claim 20, further comprising a shoe affixed to a lower portion of said elongated member, said lower arc being part of said shoe.

25. A frame according to claim 24, wherein said shoe and said elongated member include structures to accommodate attaching means for attaching a remainder of a skate to the frame.

26. A frame according to claim 24, further comprising a front wheel mounted in said first wheel housing of said elongated member and a rear wheel mounted in said second wheel housing of said elongated member.

27. A frame according to claim 26, wherein said lower arc has a longitudinal extent greater than said predeterminate distance between said axes minus a predeterminate diameter of said wheels.

28. A skate comprising:

a frame comprising a longitudinally elongated member, said elongated member comprising a front wheel housing between lateral walls at a front end of said elongated member and a rear wheel housing between lateral walls at a rear end of said elongated member;

a single pair of wheels for supporting the skate on a skating surface, said pair of wheels consisting of a front wheel and a rear wheel, said front wheel being mounted in said front wheel housing and said rear wheel being mounted in said rear wheel housing;

said front wheel being rotatable about a first axis, said rear wheel being rotatable about a second axis, said first axis being spaced from said second axis by a predeterminate distance;

said frame further comprising a downwardly facing and longitudinally extending grinding surface positioned between said wheel housings, said grinding surface extending laterally on each side of a vertical longitudinal median plane of said frame, and extending inwardly away from a planar surface supporting said pair of wheels;

said grinding surface extending in a first direction forwardly and downwardly, said first direction of said grinding surface not intersecting said front wheel;

said grinding surface further extending in a second direction rearwardly and downwardly, said second direction of said grinding surface not intersecting said rear wheel.

29. A skate according to claim 28, wherein said grinding surface has a longitudinal extent greater than a third of said predeterminate distance said first and second axes are spaced apart.

30. A skate according to claim 28, wherein said grinding surface is a single unitary surface.

* * * * *